US006135356A

United States Patent [19]

Mitzlaff et al.

[11] Patent Number: 6,135,356

[45] Date of Patent: Oct. 24, 2000

[54] METHOD FOR ADJUSTING THE SPRINKLING PATTERN OF A SPRINKLING APPARATUS AND SPRINKLING APPARATUS

[75] Inventors: Lothar Mitzlaff, Ulm; Reiner Häufele, Laupheim; Wolfgang Lindermeir, Untermarchtal; Johann Katzer, Neu-Ulm, all of Germany

[73] Assignee: Gardena Kress + Kastner GmbH, Ulm, Germany

[21] Appl. No.: 09/168,011

[22] Filed: Oct. 7, 1998

[30] Foreign Application Priority Data

Jul. 10, 1998 [DE] Germany ..... 198 30 861

[51] Int. Cl.[7] ..... B05B 17/00

[52] U.S. Cl. ..... 239/1; 239/240; 239/242; 239/566

[58] Field of Search ..... 239/240, 242, 239/246–248, 548, 550, 551, 553, 562, 566, 567, 546, 451, 455, 581.1, 602, DIG. 1, DIG. 12, 1

[56] References Cited

U.S. PATENT DOCUMENTS

| | | | |
|---|---|---|---|
| 2,952,413 | 9/1960 | Jepson | 239/242 |
| 3,498,543 | 3/1970 | Gilmour | 239/240 |
| 3,827,637 | 8/1974 | Stephany et al. | 239/242 |
| 3,854,665 | 12/1974 | Rodgers | 239/242 |
| 5,305,956 | 4/1994 | Wang . | |
| 5,350,115 | 9/1994 | Burnworth . | |
| 5,526,982 | 6/1996 | McKenzie | 239/247 |
| 5,657,928 | 8/1997 | Jian | 239/242 |

FOREIGN PATENT DOCUMENTS

| | | |
|---|---|---|
| 2 748 367 | 4/1996 | France . |
| 354 983 | 6/1922 | Germany . |
| 733 188 | 3/1943 | Germany . |
| 1 926 735 | 5/1969 | Germany . |
| 30 44 310 | 6/1982 | Germany . |
| 36 29 696 A1 | 1/1986 | Germany . |
| 37 25 384 A1 | 7/1987 | Germany . |
| 40 34 695 A1 | 10/1990 | Germany . |
| 296 05 046 U1 | 4/1996 | Germany . |
| WO 95/17262 | 12/1994 | WIPO . |

*Primary Examiner*—Andres Kashnikow
*Assistant Examiner*—Lisa Ann Douglas
*Attorney, Agent, or Firm*—Herbert Dubno

[57] ABSTRACT

In a sprinkling apparatus constructed as a square sprinkler, which has a straight nozzle row with a plurality of nozzles and directionally adjustable nozzle axes, it is possible to tilt the nozzle axes of single nozzles collectively relative to one another. A preferred embodiment has a fan-like sprinkling pattern, the jets of the fan being symmetrically or asymmetrically brought together or moved apart. The fan edges can be adjusted independently of one another.

46 Claims, 7 Drawing Sheets

METHOD FOR ADJUSTING THE SPRINKLING PATTERN OF A SPRINKLING APPARATUS AND SPRINKLING APPARATUS

FIELD OF THE INVENTION

The invention relates to a method for adjusting the sprinkler or sprinkling pattern of a sprinkling apparatus, particularly a square sprinkler. The invention also relates to as a sprinkling apparatus.

BACKGROUND OF THE INVENTION

Sprinkling apparatuses are mainly used in the horticultural field for the surface-covering water supply of plants, but can also be used for dampening other surfaces, such as e.g. sand tennis courts and the like, which are to be kept moist. A conventional sprinkling apparatus is normally set up in fixed manner, connected to a water supply and produces a sprinkling pattern, which determines the shape and size of the sprinkled surface area, as well as the sprinkling density. It is desirable for a variable use of such sprinkling apparatuses to be able to adjust the sprinkling pattern, in order to adapt the sprinkling apparatus to the intended use.

Conventional sprinkling apparatuses have a nozzle arrangement connectable to a liquid supply, particularly a water supply, and having a plurality of nozzles, whereof the nozzle axes determining the delivery direction of a nozzle are directionally variable. A nozzle arrangement is considered to be a monodimensional or multidimensional array of nozzles with substantially fixed, predetermined, relative positions. As a rule, a nozzle is constructed as a single nozzle for the delivery of a water jet, but can also be constructed as a spray nozzle for delivering a spatially more extended spray.

Reciprocating sprinkling apparatuses are already known, which have a water pipe with a plurality of nozzle openings along a top surface of the water pipe pivoting backwards and forwards about its longitudinal axis. The sprinkling width of such a square sprinkler is fixed, whereas the length of the sprinkling surface is adjustable by the pivoting width of the reciprocating movement. The adjustment possibilities of such sprinklers are limited.

In the case of a circular sprinkler known from international patent application WO 95/17262, a circular sprinkling pattern is produced by an arrangement of single nozzles, which are positioned in one or more vertical rows on a sprinkler head pivotable about a vertical axis. The partial jets of the several nozzles are combined shortly following the nozzle outlets into a single jet. The subdivision into several nozzles permits a gradual setting of the flow quantity. For adjusting the range of the uniform jet, all the single nozzles of a vertical row are simultaneously adjusted by the same angle, whilst maintaining the parallel orientation of the nozzles. Circular sprinklers are only suitable to a limited extent for watering linearly defined lawn surfaces, e.g. in the vicinity of path edges or borders. The adjustment possibilities of the known circular sprinkler are also limited to the diameter adjustment of the sprinkling surface.

OBJECT OF THE INVENTION

The object of the invention is to provide a method of and an apparatus for variable setting of the sprinkling pattern of a sprinkling apparatus in simple manner.

SUMMARY OF THE INVENTION

In the case of the method of the invention, the adjustment of the nozzle axes takes place in such a way that said axes are tilted relative to one another. As a result it is possible to modify the sprinkling density produced by the sprinkling apparatus, because the jets of a jet field produced by the nozzle arrangement can be moved apart or brought together to a greater or lesser extent. This also provides a method for adjusting or modifying the sprinkling density of a sprinkling apparatus. As a result of the relative, mutual tilting of the nozzle axes, it is also possible to modify the size of the surface to be sprinkled. If desired, with a changing sprinkling density through a modification of the water pressure, an optionally desired maintaining constant of the surface-related, average sprinkling quantity can be obtained.

In the nozzle arrangement, single nozzles can be arranged in a monodimensional or multidimensional, in particular two-dimensional field and preferably there is a uniform distribution of the single nozzles. Preference is given to a monodimensional, i.e. linear and in particular straight arrangement of the single nozzles, i.e. a straight nozzle row. As a result of the method, the nozzle axes or the liquid jets produced by the nozzle arrangement can be symmetrically or asymmetrically moved apart or brought together in fan-like manner in accordance with in particular a planar fan. An arrangement of nozzles fixed by the adjustment can be moved collectively, e.g. in such a way that a jet fan is pivoted backwards and forwards in reciprocating manner about a pendulum axis located in a fan plane.

The method permits numerous advantageous adjustment possibilities. Normally the situation is such that during adjustment nozzle axes are collectively or simultaneously tilted relative to one another. It is also possible to tilt individual nozzles or nozzle groups of the nozzle arrangement relative to the others, so that within a sprinkling field areas with different sprinkling densities can be produced.

A uniform sprinkling density in different settings can be achieved in a preferred method in that during the adjustment, the relative tilting angle between adjacent nozzle axes of the nozzle arrangement can be modified by substantially identical angular values or increments. Generally the situation is such that the nozzle axes are tilted by different absolute tilting angles during the adjustment.

It is possible, e.g. by rastering the setting possibilities, to allow a gradual adjustment of the sprinkling pattern, in order to select in planned manner specific sprinkling densities and/or areas. It is preferable if the nozzle axes can be adjusted continuously or gradually, which permits a particularly sensitive setting of the sprinkling density and/or size and/or shape of the sprinkling area.

An advantageous embodiment allows a large number of different setting possibilities or degrees of freedom of the adjustment and not only is the sprinkling density adjustable, but also, preferably independently of the sprinkling density, the position and/or shape of the sprinkling area achieved by a preferably fixed installed sprinkling apparatus. The situation can in particular be such that on adjusting at least one nozzle axis, or a group of nozzle axes, is substantially not adjusted, whereas other nozzle axes are tilted relative to the non-adjusted nozzle axes and preferably relative to one another. For example, in the case of an array of nozzles, an inner nozzle or nozzle group can remain unadjusted, whereas nozzles adjacent to the edges of the nozzle array can be tilted away from or towards the untilted nozzle axes. During said adjustment, sprinkling in the point of concentration of the sprinkling area defined by the unadjusted nozzle axes remains substantially unchanged, whereas it changes towards the edges. The situation can also be such that one or more marginal nozzles of an array remains unadjusted, whereas other nozzle axes are tilted with respect thereto. This makes it possible for a lateral limitation of the sprinkling area to maintain an unchanged position, even when adjusting the nozzle arrangement, which is e.g. of advantage in the vicinity of path borders.

A sprinkling apparatus particularly suitable for performing the method has at least one nozzle arrangement of the described type and a preferably manually operable adjusting device for adjusting the directions of the nozzle axes, the adjusting device having tilting means for tilting nozzle axes relative to one another. With regards to the nozzle arrangement, the nozzles preferably constructed as single jet nozzles are preferably distributed in a regular manner and preferably adjacent nozzles are arranged with substantially the same mutual spacings. This makes it possible in particularly simple manner to achieve uniform sprinkling densities. Preferably, the nozzle arrangement is a single, particularly linear nozzle row. It is also possible to arrange the nozzles in a two-dimensional, preferably planar field, e.g. a double row or multiple row, or in a three-dimensional arrangement.

The adjustment of the nozzle axes determining the delivery direction can be achieved by modifying the flow paths within nozzles optionally fixed during the adjustment. Particularly easily manufacturable and adjustable are nozzle arrangements, in which the single nozzles have in each case a nozzle inlet connectable to the liquid supply and, axially spaced therefrom, a nozzle outlet for liquid delivery and through the relative arrangement of nozzle inlet and nozzle outlet the nozzle-fixed nozzle axis is defined and the adjustment of the nozzle axes takes place by a relative adjustment of nozzle inlet and nozzle outlet. For adjustment purposes the nozzle inlet and/or nozzle outlet can be moved, and in preferred embodiments the nozzle outlets are substantially fixed and the nozzle outlets are movable transversely to the nozzle axis. Correspondingly the adjustment or tilting of the nozzle axes can be brought about by moving the nozzle outlets transversely to the nozzle axes.

The single nozzles of the arrangement can be separate, rigid single nozzles, which, preferably are tiltably mounted in the vicinity of the nozzle inlets, preferably in spherical or roller joints. In a preferred embodiment, the nozzle arrangement has at least one continuous, preferably strip-like nozzle body made from elastic, flexible material, on which are arranged several, preferably all the nozzles of the nozzle arrangement, preferably in one piece. The nozzle strip forming a nozzle row can be sealed in an e.g. tubular casing body of the liquid supply in such a way that the nozzle adaptors project outwards through corresponding wall openings of the casing. The tilting means of the nozzle axes can act on the outwardly projecting, flexible or pliable nozzle outlet areas.

In a preferred embodiment, the tilting means have a first guide body with at least one and preferably several first guide openings and a second guide body, movable relative to the first guide body, and having at least one and preferably several second guide openings, the guide bodies being superimposed and the guide openings are arranged so as to overlap one another, so that in the overlap or intersection area of a first and a second guide opening a nozzle guide opening is formed. A nozzle guide opening preferably surrounds a single nozzle, particularly its outlet area, on all sides and forms lateral guide faces for the nozzle. By a suitable relative movement of the guide bodies with respect to one another, there is a displacement of the positions of the overlap areas and consequently the nozzle guide openings, so that the nozzle can be tilted. The relative displacement of the guide bodies can be chosen in such a way that the geometrical arrangement of adjacent nozzle guide openings is modified relative to one another, so that a relative tilting of the nozzles against one another can be produced.

It is advantageous if the first guide openings and/or the second guide openings are formed by preferably straight longitudinal slots, particularly with substantially a constant width, the first guide openings at least zonally being inclined to the second guide openings, e.g. by an angle between 30 and 60°. Generally rhombic nozzle guide openings can be formed, whose internal diameter changes either very slightly or not at all during the relative displacement of the guide bodies.

In a preferred embodiment, the second guide body is fitted in stationary or fixed manner to a casing of the sprinkling apparatus and is in particular an integral component of the casing, whereas the first guide body is movably mounted, particularly slidably mounted on the casing. The fixed, second guide body and the movable, first guide body can in particular be constructed as straight guide ledges or bars, in which guide openings are made. The adjustment possibilities can be a vertical adjustment of the guide bodies against one another. However, normally there is a substantially planar adjustability and in particular the first guide body is displaceable against the second guide body transversely to a nozzle row and/or adjustable in inclined manner to a nozzle row.

For setting the desired sprinkling pattern, the adjusting device of a preferred embodiment has at least one, preferably manually operable control member coupled to at least one guide body for the relative adjustment of the position of the first and the second guide body. By means of a single control element, it is possible to obtain a linear relative displacement and/or a relative rotation of the guide body to an extent defined by the nature of the coupling. A preferred embodiment has several degrees of freedom of the adjustment. In particular, there are two independently operable control bodies, which preferably act on opposite ends of the movable, first guide body.

For adjusting the guide bodies against one another, it is possible to use all suitable control means. For example, an individual adjustment of the nozzles which are variable in their jet directions can take place in a virtually random combination by separate control means. However, preference is given to easily operable control means through which a collective adjustment of the separate jets can be obtained. Particular preference is given to control elements or devices, in which between the set sprinkling pattern and the position of the at least one control element, there is a conspicuous correlation. Examples of such adjusting devices, which can in particular include control elements in the form of linearly displaceable sliders or rotary, optionally lever-operated control or regulating wheels, are described in greater detail hereinafter in conjunction with the description of preferred embodiments.

These and further features can be gathered from the claims, description and drawings and the individual features, both singly or in the form of subcombinations, can be implemented in an embodiment of the invention and in other fields and can represent advantageous constructions. The subdivision of the application into individual sections and the subtitles in no way limit the general validity of the statements made thereunder.

BRIEF DESCRIPTION OF THE DRAWING

Embodiments of the invention are shown in the drawings and are described in greater detail hereinafter relative to the attached drawings, wherein show.

DETAILED DESCRIPTION OF EMBODIMENTS

Figure 1:
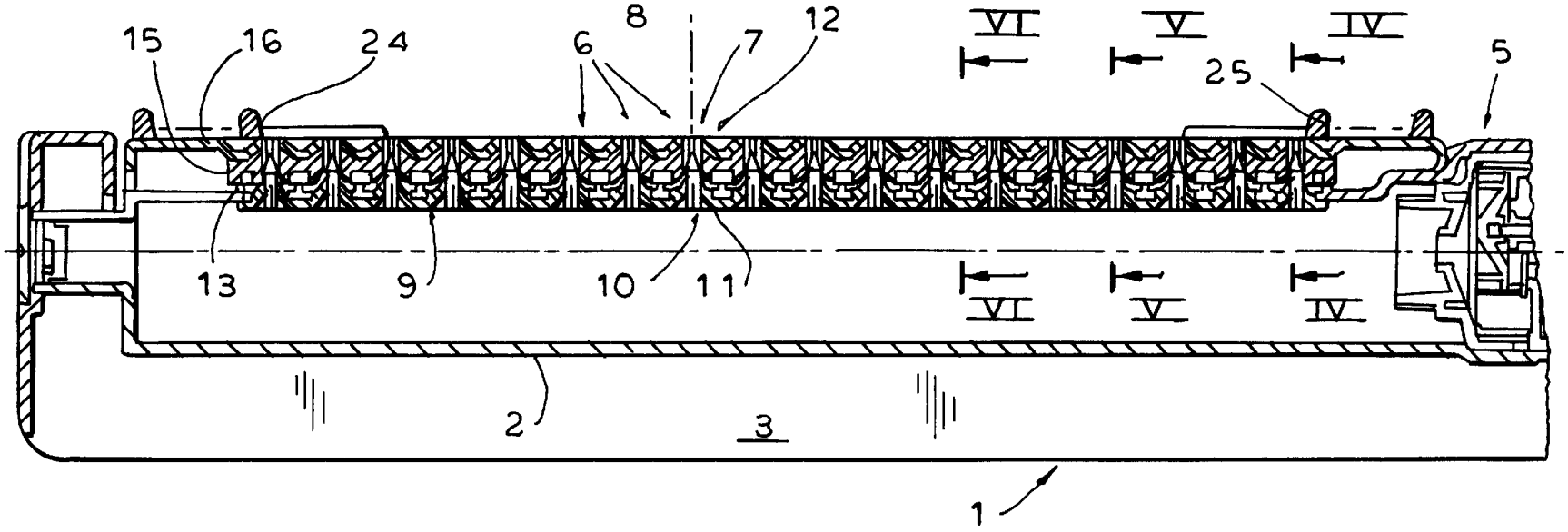
FIG. 1 A longitudinal section in a vertical plane through a sprinkler casing of an embodiment of an inventive sprinkling apparatus.
Figures 4, 5, 6:
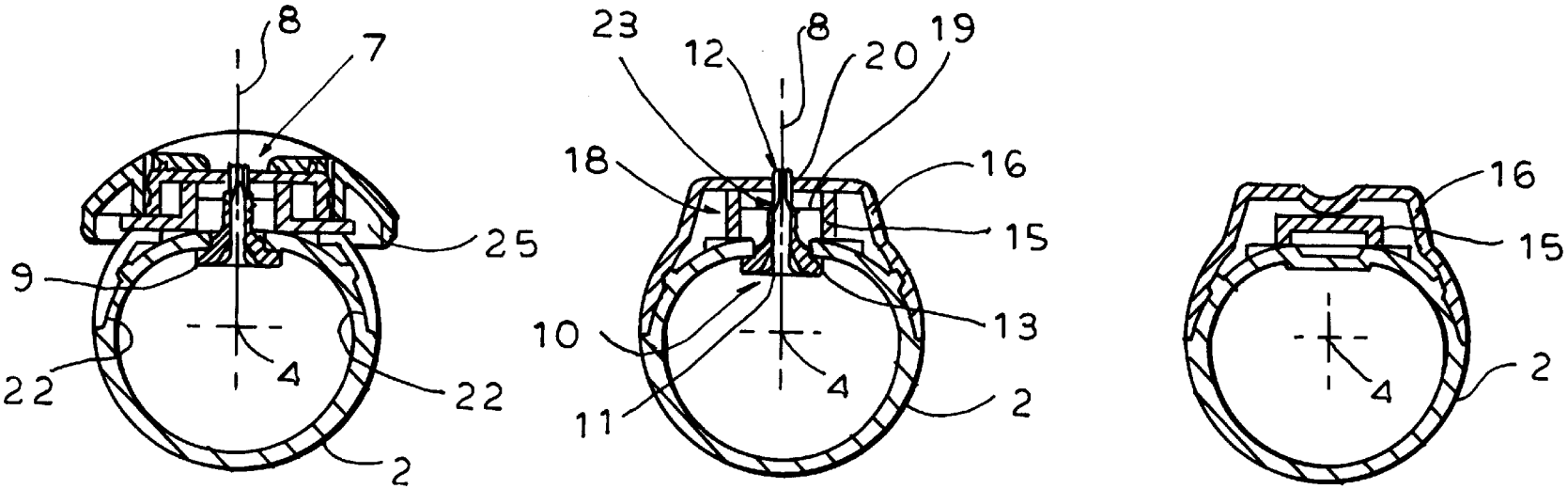
FIG. 4 A cross-section along line IV—IV of the sprinkling apparatus of FIG. 1.
FIG. 5 A cross-section along line V—V in FIG. 1.
FIG. 6 A cross-section along line VI—VI in FIG. 1.

FIG. 1 shows a longitudinal section along a vertical plane through an embodiment of a sprinkling apparatus 1 constructed as a square sprinkler. A cross-sectionally oval, tubular plastic sprinkler casing 2 (FIGS. 4, 5 and 6) is mounted in rotary manner about its longitudinal axis 4 in an approximately semicylindrical, open-top base 3 (FIG. 2) and can be reciprocated backwards and forwards about the longitudinal axis by a, water-operated drive 5. On the top of the sprinkler casing is arranged a nozzle arrangement 6 in the form of a straight nozzle row with eighteen uniformly mutually spaced single nozzles 7 in the longitudinal direction of the nozzle row. Each of the nozzles delivers a water jet in a delivery direction coinciding with the nozzle axis 8, if a liquid supply passes water under pressure into the interior of the casing 2.

The nozzles of the nozzle arrangement are constructed in one piece with the strip on a continuous, strip-like nozzle body or nozzle strip 9 of rubber-like or similar elastic, flexible material. Each of the single nozzles 7 according to FIGS. 4 and 5 has a nozzle inlet 10 widening in funnel-like manner towards the interior of the sprinkler casing and which has about its inner circumference several inwardly directed, axial guide webs 11 for the low turbulence water guidance. Further in the direction of the nozzle outlet 12, following a substantially cylindrical portion, there is a portion with an internal cross-section continuously reduced towards the outlet 12 and which passes into an outlet-side outer portion with a substantially cylindrical inner cross-section. The outer contour of the nozzles tapers in a transition towards the outlets. This nozzle shape is particularly advantageous for the deformation towards the jet direction change taking place in the inventively constructed sprinklers, because there is no bending of the continuous taper, even in the case of more pronounced bends round of e.g. up to approximately 40° with respect to the shown vertical orientation.

In the vicinity of the nozzle inlets 11, the nozzles are inserted from the interior of the sprinkler casing 2 in a row of nozzle-holding openings 13 in a self-holding and self-sealing manner by means of barb-like projections. As a result of the rubber-like nature of the nozzles, the nozzle outlets 12 can be laterally tilted or bent round against the nozzle inlets 10 compared with the shown, untilted parallel position of the nozzles, as will be explained hereinafter.

Figure 3:
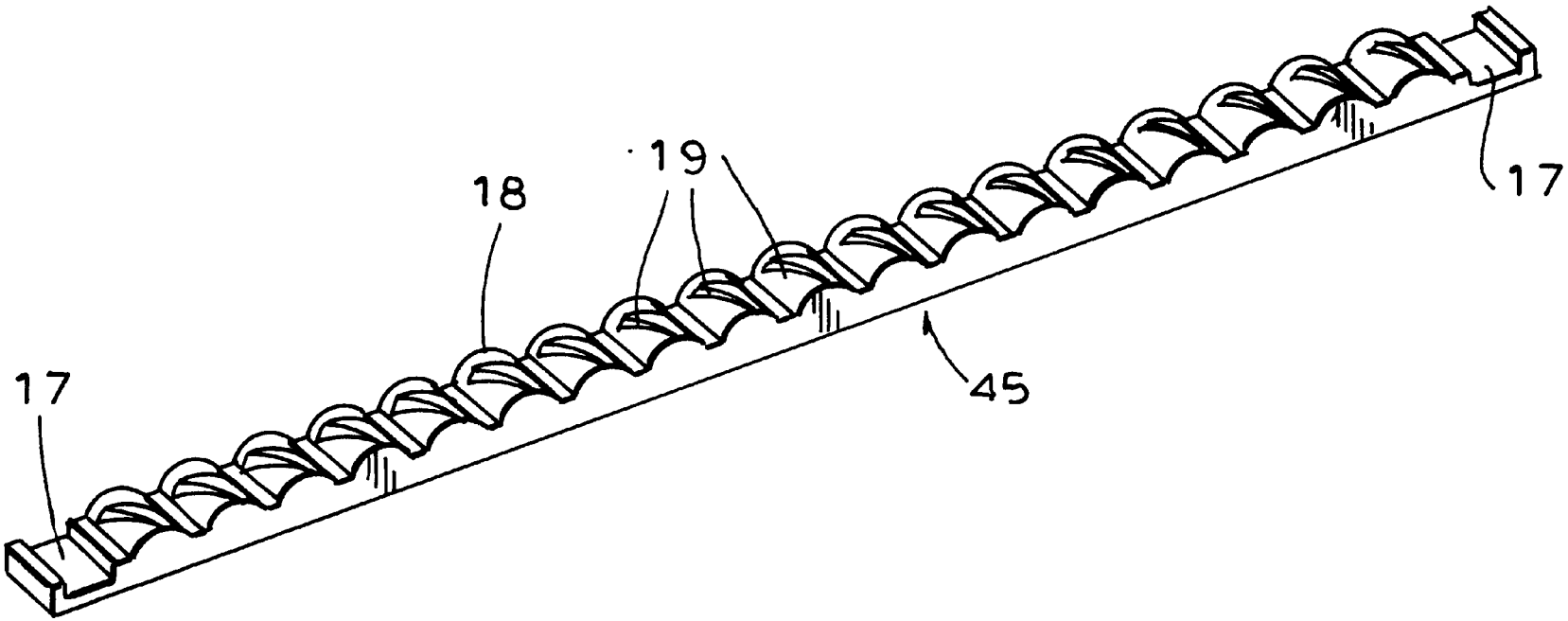
FIG. 3 An inclined perspective view of a ledge-like, movable, first guide body with a plurality of guide slots inclined in the longitudinal direction.

Above the casing 2 with the nozzle-holding openings 13 is provided a first guide body 15 movable with respect to the casing transversely to the axis 4 and which is in the form of a long, straight plastic ledge, which is upwardly covered by a ledge 16 forming a second guide body and fixed with respect to the casing 2. The ledge 15 visible in FIG. 3 and which has at both ends upwardly open rectangular grooves 17 running perpendicular to the longitudinal direction thereof and having a guidance function during the transverse displacement of the ends, has in the longitudinal direction a number, corresponding to the number of nozzles, of approximately cylinder jacket-like upward bulges 18 running transversely to the longitudinal direction. In the vicinity of each of the bulges is provided a vertical, through, longitudinal slot 19 at an angle of approximately 60° to the longitudinal direction of the ledge and whose slot width substantially corresponds to the external diameter of the nozzles 7 in the vicinity of the nozzle outlets 12. In the assembled state of the sprinkler (FIG. 1), one of the nozzles 7 of the nozzle row projects through each of the slots.

Figure 2:
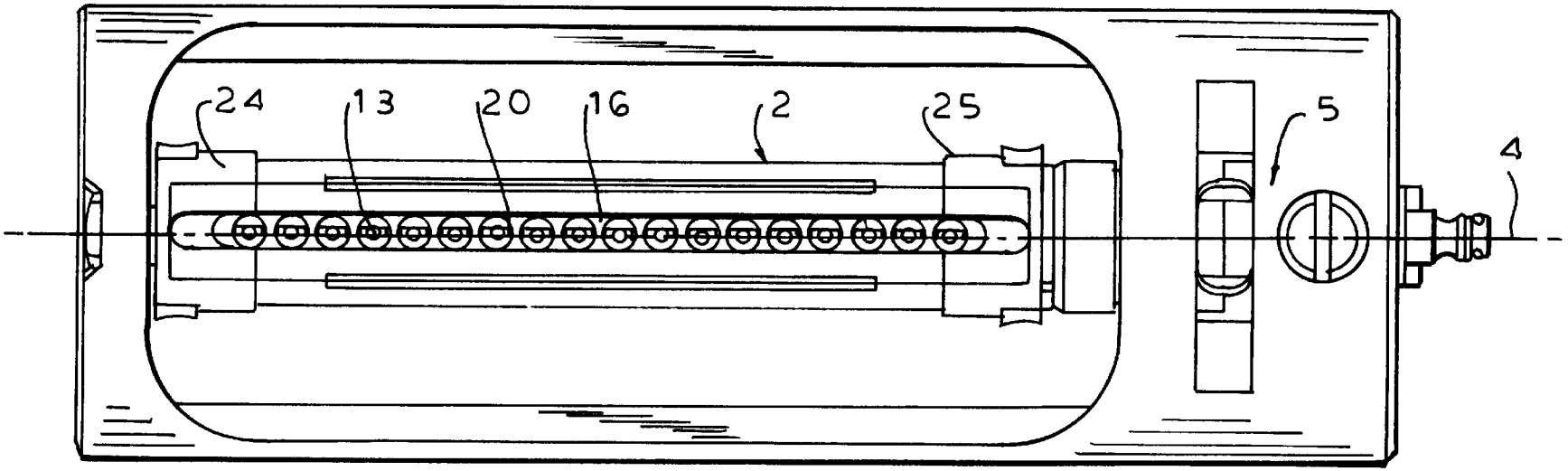
FIG. 2 A plan view of a sprinkler casing of the type shown in FIG. 1, which is pivotably mounted about its longitudinal axis in a base of the sprinkling apparatus.

The movable ledge 15 cooperates with the fixed, second ledge, arranged over the ledge 15 in the plan view of FIG. 2 and which along its longitudinal direction has a number of longitudinal slots 20 corresponding to the number of nozzles and whose longitudinal direction is oriented parallel to the longitudinal direction of the nozzle row. In place of the row of uniformly spaced, elongated slots 20, which in each case only guide one nozzle, it is possible to provide a longer, optionally through guide slot, which laterally guides several and in particular all the nozzles. As can be gathered from FIGS. 1, 4, 5 and 6, the fixed ledge 16 is a part separate from the sprinkler casing 2 and which is inserted axially in the longitudinal direction into axially directed longitudinal grooves 22 of the casing outside. The second ledge 16 can also be a component of the sprinkler casing. In the case of FIG. 1, the fixed ledge has a uniform wall thickness and a shape following the periodic upward bulging of the displaceable ledge (FIG. 1), account being taken of the possible inclined position of the displaceable ledge 15 with respect to the fixed ledge 16 in the form of upward bulges.

The two ledges 15, 16 are superimposed in contacting manner, the second ledge 16 being fixed with respect to the nozzle ledge and the first ledge 15 is displaceable transversely to the nozzle row (perpendicular to the paper plane of FIG. 1), optionally parallel to the axis 4 and/or adjustable in inclined manner to the nozzle row. An adjustment of the first ledge in the longitudinal direction of the casing is prevented by the interengaging bulges.

Figure 7:
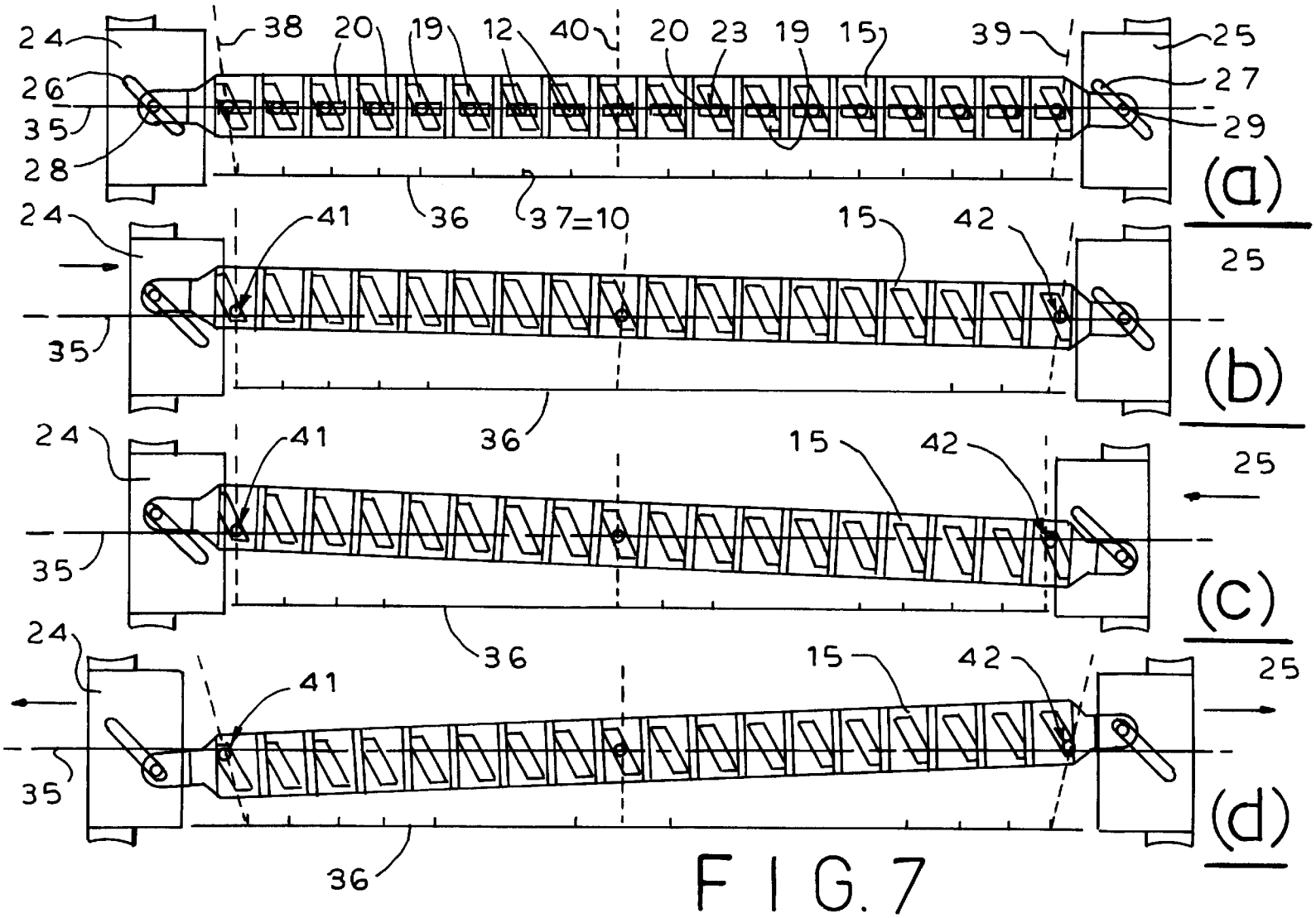
FIG. 7 Different settings of the guide bodies of the sprinkling (*a*)–(*d*) apparatus according to FIGS. 1 to 6 which are displaceable against one another.

As can be readily seen in FIG. 7 (*a*), the overlapping or intersecting through slanting slots 19 of the first edge 15 and the through longitudinal slots 20 of the fixed ledge 16 define in their intersection area or at the intersections rhombic nozzle guide openings 23 for the nozzle outlets and therefore provide for each nozzle a position of the nozzle outlets dependent on the variable relative position of the guide bodies 15, 16 and therefore the tilting position of the nozzle axes. The wall thicknesses of the ledges 15, 16 in the vicinity of the slots 19, 20 are appropriately such that the inner faces of the slots engaging on the nozzle form guide faces for the cylindrical portion of a nozzle, by which the latter can be tilted in the desired direction, without the nozzle being squeezed.

For adjusting the first ledge 15 with the slots 19 slanting towards the nozzle row is in each case provided in the end region of said ledge a mechanical device acting on the ledge end and which is so mechanically coupled to the ledge end, that an adjustment of the device displaces the particular ledge end transversely to the nozzle row. Each ledge end can be displaced independently of the other ledge end in the transverse direction, which increases the number of degrees of freedom of the settings with respect to an also possible, purely pivoting movement of the adjustable ledge about an axis perpendicular to the paper plane.

The lateral displacement of the ends of the first ledge 15 takes place in the shown embodiment by mechanically operable control devices or elements in the form of sliders 24, 25, via guide slots 26, 27, provided in the sliders, and which run in slanting manner to the longitudinal direction of the ledge or to the displacement direction and in each of which engages a driving pin 28, 29 of a link forming an extension of the ledge.

The method for adjusting the sprinkling pattern of a square sprinkler performable with this embodiment is explained hereinafter with particular reference to FIGS. 7 and 8. FIGS. 7 shows four different relative positions of the displaceable ledge 15, provided with the slanting slots 19, relative to the fixed, second ledge, whereof only the longitudinal slots 20 running in the longitudinal direction of the nozzle arrangement are shown in FIG. 7 (*a*). The statements "top" and "bottom" are related to the plane and orientation of the drawing and in connection with the sprinkler refer to directions perpendicular to the longitudinal axis 4 and parallel to the underside plane of the ledge 15. The views in FIG. 7 are in each case plan views of the ledge arrangement in a central position of the sprinkler casing 2 pivotable backwards and forwards periodically about a horizontal pivoting axis 4, parallel to the nozzle row, for surface sprinkling purposes.

In the position shown in FIG. 7 (*a*), the displaceable, first ledge 15 is in a central position of the sliders 24, 25, in which a longitudinal plane of the displaceable ledge of a median nature with respect to the lateral displaceability coincides with the vertical longitudinal plane through the nozzle row (sectional plane in FIG. 1) and the median plane through the longitudinal slots 20 of the fixed ledge (broken line 35). The row of longitudinal slots 20 of the second ledge is only represented by the broken line 35 in FIG. 7 (*b* to *d*). Some nozzle outlets 12 are represented by circles in the intersections 23 of the overlapping slanting slots 19 and longitudinal slots 20 of both ledges. On a line 36 drawn below the ledge arrangement in FIG. 7 (*a*) are marked by positioning lines 37 the positions of the nozzle inlets 10, which are in each case vertically below the centre of the longitudinal slots 20 (FIG. 1). At the ends of the ledge arrangement, in FIG. 7 the positions 37 of the nozzle inlets are linked with the nozzle outlets 11 by the dotted lines 38, 39 representing the nozzle axes. The lines 38, 39 indicate the delivery direction of the furthest outwards located marginal nozzles of the nozzle row.

For a central nozzle 40, in FIG. 7 (*a*), the intersection of the slots 19, 20 is directly vertically over the nozzle inlet 10 and the nozzle delivers a vertical jet (or a jet pivoted in a vertical plane). For the outer nozzles, the intersection is further outwards than the nozzle inlet, so that for these nozzles the outlet is tilted outwards and the nozzles deliver an outwardly tilted jet. The intermediate nozzles are tilted in outwardly increasing manner against the vertical, so that there is a symmetrical, flat fan with substantially identical angular steps between adjacent jets. This fan widening in the case of a parallel positioning of the ledges is obtained in the embodiment in that the spacing in the longitudinal direction of the nozzle row between adjacent slanting slots 19 of the movable ledge is larger by a few per cent than the corresponding longitudinal spacing of adjacent positions of the nozzle inlets.

In FIG. 7 (*b*) the row of longitudinal slots 20 of the fixed, second ledge is only represented by an interrupted line 35. Compared with the setting in FIG. 7 (*a*), here the left-hand slider 24 is displaced towards the centre of the nozzle row and over the pin guide 26 in the slider the left-hand of the displaceable ledge 15 is displaced laterally, i.e. "upwards" in the drawing, so that the first, displaceable ledge now slants to the longitudinal direction 35 of the nozzle row. The gradual displacement of the left-hand ledge end leads to the nozzle outlet of the left outer marginal nozzle 21 being located vertically above the associated nozzle inlet and delivers a jet in the vertical direction. The jet direction of the right outer marginal nozzle 42 is substantially unchanged compared with the position of FIG. 7 (*a*). The intermediate nozzles are tilted to the right by an amount decreasing from left to right compared with the position of FIG. 7 (*a*). This ledge position corresponds to the fan pattern according to FIG. 8 (*b*).

Compared with FIG. 7 (*b*), in FIG. 7 (*c*), by a linear movement of the right-hand slider 25 towards the centre, the right-hand end of the displaceable ledge has been displaced "downwards" and the right outer marginal nozzle 42 now gives, like the left outer marginal nozzle 41, a vertically upwardly directed jet. Corresponding to the uniform, collective adjustment of all the nozzles in this embodiment and the sprinkler-typical jet orientation, now all the jets or nozzles axes are parallel. As a result the angular increment between adjacent nozzles disappears. The ledge position corresponds to the fan pattern of FIG. 8 (*a*).

Finally, in FIG. 7 (*d*) is shown another extreme position with sliders 24, 25 drawn entirely to the outside and with an opposite inclined position of the displaceable ledge 15 compared with FIG. 7 (*c*). The corresponding fan pattern with symmetrically fully widened, planar fans corresponds to the fan pattern of FIG. 8 (*e*).

The embodiment described with the aid of the preceding drawings with ledge adjustment by means of sliders 24, 25 is characterized by an advantageous, conspicuous correlation of the slider movement with the change in the fan edge or border on the side of the particular slider. This is explained relative to FIG. 8, which shows different settings of a planar jet fan formed by a group of eighteen, substantially coplanar water jets 30, as a function of the position of the two sliders 24, 25. In FIG. 8 (*a*) the two sliders are in an extreme inner position and the fan pattern of the nozzle jets is also an extreme case in the sense that here all the jets or nozzle axes are oriented in parallel. A jet orientation with convergent jets is admittedly possible with a corresponding apparatus design, but is not generally provided. Through a displacement of the right-hand slider 25 into an intermediate position towards the outside, the right-hand edge of the jet fan is tilted to the right. The jet directions or nozzle axes of the entire nozzle row, with the exception of the outermost, left-hand marginal nozzle 41, are tilted to the right collectively or simultaneously, but by different absolute angular values, so that in each case the angle between adjacent jets is increased and preferably a fan is formed with at least approximately the same angular step of e.g. 1° between individual jets. The overall widening of the fan then results from the sum of the relative tilting angles between adjacent jets or nozzle axes corresponding to the total number of nozzles in the nozzle row. The sprinkling density in the sprinkled square decreases compared with the position of FIG. 8 (*a*), whereas the overall surface of the sprinkled square is increased to the right-hand side and there is no change to the position of the left-hand edge.

Figure 8:
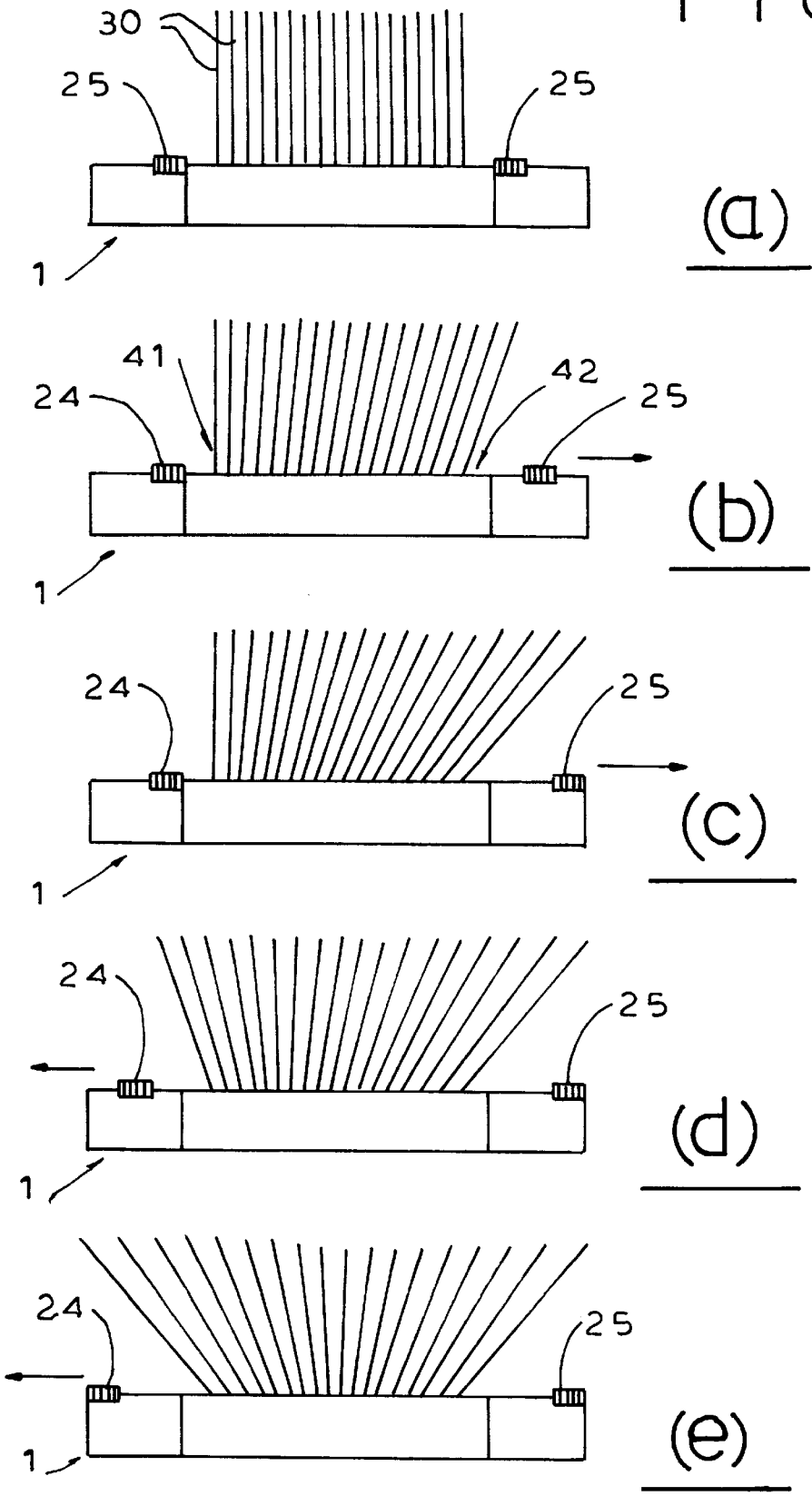
FIG. 8 Different settings of the jet fan which can be produced by the (*a*)–(*e*) sprinkling apparatus, as a function of the position of the terminally arranged slider.

In FIG. 8 (*c*), the right-hand slider 25 is displaced entirely to the outside and the right-hand fan edge, accompanied by an increase in the aforementioned angular increment to e.g. 2°, is in its outermost slanting orientation, whilst the left-hand fan edge remains unchanged. Correspondingly, independently of the setting of the right-hand fan edge, by displacing the left-hand slider 24, a change in the orientation of the left-hand fan edge can be obtained. In the fan settings of FIG. 8 (*d*) and (*e*), the uniform relative angles between the single jets are approximately 4 or 5°. It is clear here that in the case of the sprinkling apparatus the sprinkling density, which is here determined by the fanning angle of the nozzle row, and the average discharge or delivery direction can be adjusted or modified continuously in gradual manner independently of one another.

An inventive method for the variable adjustment of the sprinkling pattern of a square sprinkler and an apparatus particularly suitable for the performance thereof have been described in exemplified manner hereinbefore. Numerous undescribed variants are conceivable. For example, alternatively or additionally to the transverse displacement of a guide body with inclined guide slots, there can also be a vertical adjustment of the guide bodies relative to one another and both a parallel vertical adjustment at several ends, particularly at two ends of an adjustable guide body, and an independent vertical adjustment e.g. on two ledge ends is possible. For example, a lowering of a movable ledge in the direction of the nozzle inlets can modify and in particular increase an already existing tilting position of the nozzles.

In place of elastic nozzles with a fixed nozzle base in the inlet area and a bend-round duct in the outlet area, rigid nozzles can be provided, which are e.g. individually tiltably mounted in the inlet regions in spherical or roller joints. In a roller bearing only permitting a planar pivoting movement of the rigid nozzles, there may be no need for a longitudinal guide, as obtained in the described embodiment through the longitudinal slots 20 of the fixed ledge. The mechanical means for adjusting the jet directions can act e.g. on the rollers of the tiltable bearing or mounting, besides on the nozzle outlets.

It is also not vital to combine the longitudinal slots 20 with slanting slots 19, but is very advantageous. An alternative is e.g. constituted by a displaceable ledge, in which the guide slots for the nozzle outlets corresponding to the slanting slots 19 tend to move apart in fan-like manner transversely to the longitudinal direction. If such a ledge is laterally displaced transversely and in particular at right angles to its longitudinal direction, the fan pattern of the sprinkler can be in the form of a symmetrical fan with variable opening width. Obviously the ends of such a ledge can also be adjusted independently of one another. Particularly in an embodiment with fan-like moving apart longitudinal slots, the displaceable ledge can undergo through a suitable construction of the control device a parallel displacement in the longitudinal direction, in addition to the parallel transverse displacement transversely to the longitudinal direction. The transverse displacement brings about a change to the fan opening angle and the angle step width between adjacent jets, whilst the longitudinal displacement can bring about a lateral tilting of the entire fan in the longitudinal direction of the nozzle row.

A simple embodiment having only one degree of freedom of movement and which only allows one variation of the opening width, can be created by a movable ledge pivotable about a vertical axis in the centre of the nozzle row. The individual guide slots need not necessarily be linear and the guide bodies need not be planar. For example, the movable ledge, in place of a planar shape, can also be curved in the form of a pipe jacket or pipe jacket segment and can be mounted so as to slide on an outer face of a roller-like sprinkler casing.

The described control device with the two sliders 24, 25 is inter alia advantageous due to the conspicuous correlation between the slider displacement direction and the adjustment of the fan edges. As is particularly shown in FIG. 4, the sliders need not only be fixed to the top of the sprinkling apparatus and guided in longitudinal grooves, but it is instead e.g. possible to provide a pipe-embracing slider, in which the casing pipe 2 forms the slider guide.

Figure 9:
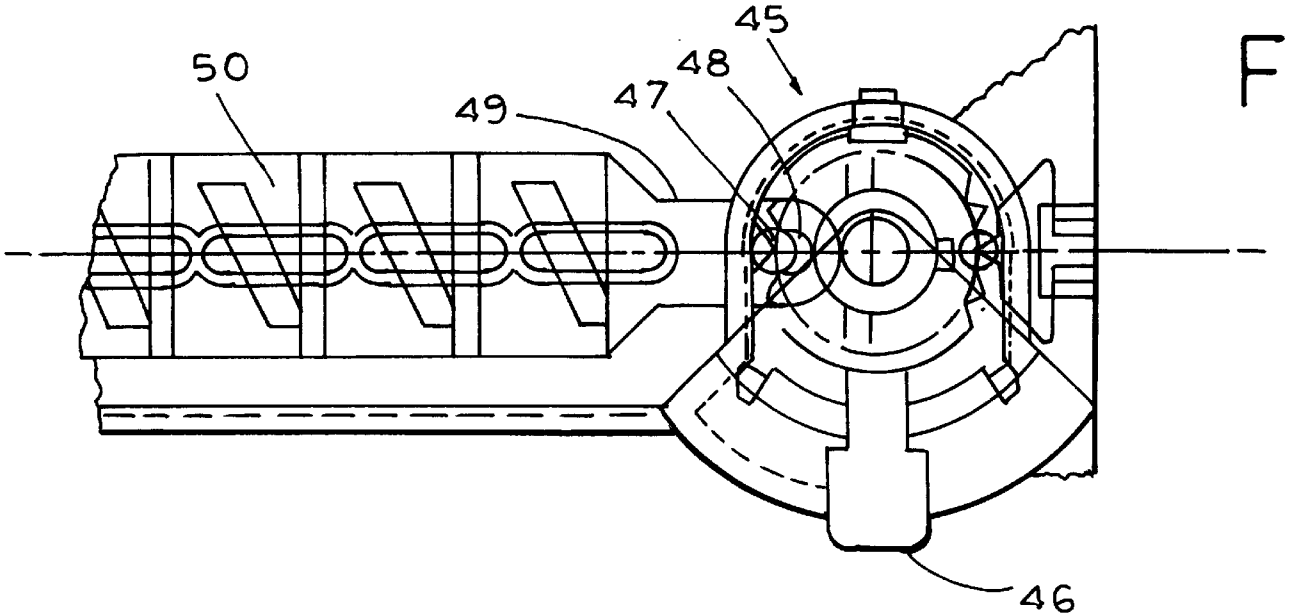
FIG. 9 Another embodiment of a sprinkling apparatus in the vicinity of a control device having a control wheel.

Through the sliders, control devices with actuating elements linearly displaceable in the sprinkler longitudinal direction are possible, which directly or indirectly, by means of a linear-linear coupling, bring about a linear transverse displacement of one side of the movable guide body. It is possible as an alternative to provide rotary actuating elements, which by means of a rotary-linear coupling bring about such a linear displacement of one side of a guide body. For example, in place of a slider, can be provided e.g. on the top surface or laterally on the casing body a rotary knob, which by means of a cam arrangement or eccentric driving pin brings about a corresponding displacement of the movable ledge. In the embodiment of FIG. 9, the control element is in the form of a horizontal, rotary control or regulating wheel 45, which can have an operating lever 46 projecting over its circumference. Eccentrically on the control wheel adjustable in locked steps is provided a driving pin 47, which engages in an elongated hole 48, which engages in a terminal extension link 49 of a laterally displaceable, ledge-like guide body 50. By turning the control wheel by means of the operating lever, the pin engaging in the elongated hole displaces the ledge end transversely to the longitudinal axis of the ledge.

Figure 10:
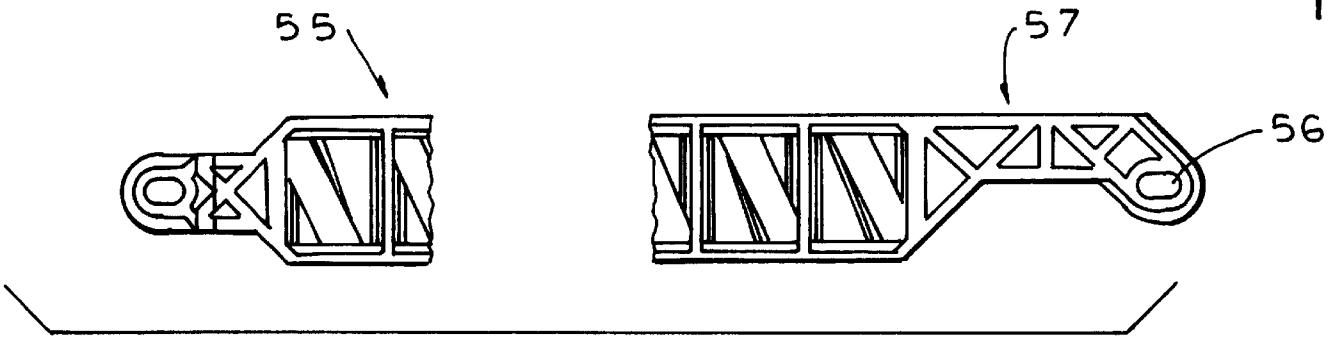
FIG. 10 A movable guide ledge or rail of another embodiment.

In a construction according to FIG. 9, a turning of the lever 47 in the inwards direction leads to a tilting of the right-hand fan edge in the outwards direction. In order to achieve an advantageous, conspicuous correlation of the direction of the lever displacement with the direction of the change of the fan edge, in another embodiment shown in FIG. 10, in the case of the movable guide ledge 55 the link 57 having the elongated hole 56 is shaped in such a way that it embraces in a lateral arc the control wheel and the elongated hole is located on the side of the axis of the control wheel remote from the ledge. As a result the coupling is such that during a movement of the right-hand operating lever to the outside, the right-hand end of the ledge is moved "upwards". As a result the right-hand side of the fan, as in FIGS. 7 (*d*) or 8 (*a*), (*b*), (*c*), is also moved outwards.

The invention has been explained relative to the example of a square sprinkler. However, with a corresponding design of the cooperating elements, it can also be used for circular sprinklers and movement devices with differently shaped movement surfaces.

We claim:

1. A method of adjusting a sprinkling pattern of a sprinkling apparatus, the sprinkling apparatus being a square sprinkler and having a nozzle arrangement which is connectable to a supply for liquid and which comprises a plurality of nozzles, wherein each nozzle has a nozzle axis and wherein the nozzle axes of the nozzles of the nozzle arrangement are directionally variable wherein the method comprises the step of adjusting at least some of the nozzle axes in such way that the nozzle axes are tilted collectively relative to one another.

2. The method according to claim 1 wherein, during adjusting, the nozzle axes are moved relatively in a fan-like manner.

3. The method according to claim 1 wherein, during adjusting, the nozzle axes are moved relatively in a flat fan pattern.

4. The method according to claim 1 wherein relative tilting angles are formed between the adjacent nozzles and wherein, during adjusting, the relative tilting angles are modified by substantially identical angular values.

5. The method according to claim 1 wherein, during adjusting, at least some of said nozzle axes are tilted by different absolute tilting angles.

6. The method according to claim 1 wherein, during adjusting, at least some of said nozzle axes are continuously tilted.

7. The method according to claim 1 wherein the sprinkling apparatus creates a sprinkling density and a sprinkling area with a sprinkling area location and wherein, during adjusting, the sprinkling density is adjusted independently of the sprinkling area location.

8. The method according to claim 1 wherein the sprinkling apparatus creates a sprinkling density and discharges liquid in an average discharge direction and wherein, during adjusting, the sprinkling density is adjusted independently of the average discharge direction.

9. The method according to claim 1 wherein, during adjusting, at least one of said nozzle axes is substantially not adjusted, whereas others of said nozzle axes are tilted relative to said at least one nozzle axis.

10. The method according to claim 9 wherein the other nozzle axes are tilted relative to one another.

11. The method according to claim 9 wherein, during adjusting, the nozzle axis of one of an inner nozzle and an inner nozzle group located within the nozzle arrangement is substantially not adjusted whereas nozzle axes of nozzles adjacent to edges of the nozzle arrangement are tilted relative to the unadjusted nozzle axis or axes.

12. The method according to claim 9 wherein, during adjusting, a nozzle axis of at least one marginal nozzle of a nozzle arrangement is substantially not tilted and other nozzle axes are tilted with respect to the marginal nozzle axis.

13. A sprinkling apparatus comprising at least one nozzle arrangement, the nozzle arrangement being connectable to a supply for liquid and having a plurality of nozzles, the nozzles having directionally adjustable nozzle axes, and the sprinkling apparatus being a square sprinkler and the sprinkling apparatus further comprising an adjusting device for adjusting the direction of the nozzle axes, wherein the adjusting device has tilting means for tilting at least some of said nozzle axes relative to one another.

14. The sprinkling apparatus according to claim 13 wherein the adjusting device is adapted for tilting the nozzle axes collectively relative to one another.

15. The sprinkling apparatus according to claim 13 wherein the nozzle arrangement has a regular distributions of single-jet nozzles.

16. The sprinkling apparatus according to claim 13 wherein the nozzle arrangement is a single, linear nozzle row.

17. The sprinkling apparatus according to claim 13 wherein each of said nozzles has a nozzle inlet connectable to the supply for liquid and a nozzle outlet axially spaced apart from the nozzle inlet for liquid delivery purposes, and wherein the respective nozzle axis is defined through the relative arrangement of the nozzle inlet and the nozzle outlet and wherein adjusting of the nozzle axis is effected by adjusting locations of the nozzle inlet and the nozzle outlet relatively.

18. The sprinkling apparatus according to claim 17 wherein the nozzle inlet is substantially fixed and the nozzle outlet is moveable transversely to the nozzle axis.

19. The sprinkling apparatus according to claim 13 wherein the nozzle arrangement has at least one continuous nozzle body made from elastic, flexible material, wherein the nozzle body comprises at least several of the nozzles of the nozzle arrangement.

20. The sprinkling apparatus according to claim 19 wherein the nozzle body is made from one piece and comprises all the nozzles of the nozzle arrangement.

21. The sprinkling apparatus according to claim 13 wherein each of said nozzles has a nozzle inlet widened in funnel-like manner toward an inlet side, and wherein the nozzle inlet comprises inwardly directed axial guide webs for low turbulence water guidance.

22. The sprinkling apparatus according to claim 13 wherein each of said nozzles has a nozzle inlet and a nozzle outlet and a portion with continuously decreasing inner cross section between the nozzle inlet and the nozzle outlet.

23. The sprinkling apparatus according to claim 22 wherein an outlet-side outer portion of each nozzle has a substantially cylindrical inner cross-section.

24. The sprinkling apparatus according to claim 13 wherein each of said nozzles has a nozzle inlet and a nozzle outlet and an external diameter at least zonally tapering from the nozzle inlet to the nozzle outlet.

25. The sprinkling apparatus according to claim 13 wherein the tilting means comprises a first guide body with a plurality of first guide openings and a second guide body moveable relative to the first guide body and having a plurality of second guide openings, the guide bodies being moveable relative to one another and being superimposed with the guide openings overlapping in an overlap area, the guide openings overlapping in such a way that in an overlap area of a first and a second guide opening a nozzle guide passage is formed.

26. The sprinkling apparatus according to claim 25 wherein at least one of the first guide openings and the second guide openings are formed by longitudinal slots and wherein the first guide openings are at least zonally slanting with respect to the second guide openings.

27. The sprinkling apparatus according to claim 26 wherein the longitudinal slots are straight and have a substantially constant width.

28. The sprinkling apparatus according to claim 25 wherein the second guide body is fixed to a casing of the sprinkling apparatus and wherein the first guide body is movably mounted on the casing.

29. The sprinkling apparatus according to claim 25 wherein the sprinkling apparatus has a casing and wherein the second guide body is an integral component of the casing of the sprinkling apparatus.

30. The sprinkling apparatus according to claim 25 wherein the sprinkling apparatus has a casing and the first guide body is slidably mounted on the casing.

31. The sprinkling apparatus according to claim 25 wherein at least one of the first guide body and the second guide body is constructed as a straight guide ledge.

32. The sprinkling apparatus according to claim 25 wherein the nozzle arrangement comprises at lest one nozzle row and wherein the first guide body is displaceable with respect to the second guide body transversely to a nozzle row of the nozzle arrangement.

33. The sprinkling apparatus according to claim 25 wherein the nozzle arrangement comprises at least one nozzle row and wherein the first guide body is adjustable in slanting manner to a nozzle row of the nozzle arrangement.

34. The sprinkling apparatus according to claim 13 wherein the sprinkling apparatus is constructed so as to produce a sprinkling density and to create a sprinkling area with a sprinkling area location and wherein the sprinkling density can be set independently of the sprinkling area location.

35. The sprinkling apparatus according to claim 13, wherein the sprinkling apparatus is constructed to produce a sprinkling density and an average delivery direction and wherein the sprinkling density and the average delivery direction are adjustable independently of one another.

36. The sprinkling apparatus according to claim 35 wherein the sprinkling density is defined by a total fanning angle of the nozzle axes of a nozzle row.

37. The sprinkling apparatus according to claim 13 wherein the sprinkling apparatus has a first guide body and a second guide body and wherein the adjusting device has at least one control element coupled to at least one of said guide bodies for the adjustment to the relative positions of the first and second guide body.

38. The sprinkling apparatus according to claim 37, wherein there are provided two independently operable control elements for the guide bodies.

39. The sprinkling apparatus according to claim 38 wherein the two control elements are coupled to the first guide body so that they act on opposite ends of the first guide body.

40. The sprinkling apparatus according to claim 13 wherein the nozzle arrangement comprises a nozzle row and wherein the sprinkling apparatus has two guide bodies and wherein the adjusting device has at least one rotary control element coupled to at least one of said guide bodies by means of a rotary-linear coupling in such a way that rotation of the control element brings about a linear displacement of one side of said one of said guide bodies transversely to a nozzle row of the nozzle arrangement.

41. The sprinkling apparatus according to claim 40 wherein the control element is a control wheel rotatable about a control wheel axis and comprising a driver positioned eccentrically to the control wheel axis, and wherein said one of said guide bodies comprises an elongated hole in an end region thereof and wherein the driver engages in the elongated hole.

42. The sprinkling apparatus according to claim 13 wherein the nozzle arrangement comprises a nozzle row and wherein the sprinkling apparatus has a displaceable guide body and wherein the adjusting device has at least one linearly displaceable control element which is coupled to the guide body in such a way that a linear displacement of the control element brings about a linear displacement of one side of the guide body transversely to a nozzle row of the nozzle arrangement.

43. The sprinkling apparatus according to claim 42 wherein the control element is coupled to the guide body by means of a linear-to-linear coupling.

44. The sprinkling apparatus according to claim 43 wherein the control element is a slider moveable in a longitudinal direction of the guide body and comprises a guide slot slanting relative to the longitudinal direction and wherein the guide body has a driver positioned in the end region of the guide body and wherein the guide slot engages the driver.

45. A sprinkling apparatus comprising at least one nozzle arrangement, the nozzle arrangement being connectable to a supply of liquid and having a plurality of nozzles, the nozzles having directionally adjustable nozzle axes, the sprinkling apparatus further comprising a device for adjusting the direction of the nozzle axes, wherein the adjusting device has tilting means for tilting nozzle axes relative to one another, wherein the tilting means comprise a first guide body with a plurality of first guide openings and a second guide body moveable relative to the first guide body and having a plurality of second guide openings, wherein the guide bodies are moveable relative to one another and are arranged in superimposed manner with the guide openings overlapping in an overlap area and wherein the guide openings overlap in such a way that in an overlap area of a first and a second guide opening a nozzle guide passage is formed, said nozzles extending into said passages.

46. The sprinkling apparatus according to claim 45 wherein at least one of the first guide openings and the second guide openings are formed by longitudinal slots and wherein the first guide openings are at least zonally slanting with respect to the second guide openings.

* * * * *